US009867247B2

(12) United States Patent
Hsu et al.

(10) Patent No.: US 9,867,247 B2
(45) Date of Patent: Jan. 9, 2018

(54) LIGHT EMITTING DIODE DRIVER

(71) Applicant: LITE-ON TECHNOLOGY CORP., Taipei (TW)

(72) Inventors: Ting-Yi Hsu, Taipei (TW); Shang-Jin Yan, Taipei (TW); Yu-Kang Lo, Taipei (TW)

(73) Assignee: Lite-On Technology Corp., Taipei (TW)

( * ) Notice: Subject to any disclaimer, the term of this patent is extended or adjusted under 35 U.S.C. 154(b) by 0 days.

(21) Appl. No.: 15/214,736

(22) Filed: Jul. 20, 2016

(65) Prior Publication Data

US 2017/0231047 A1 Aug. 10, 2017

(30) Foreign Application Priority Data

Feb. 5, 2016 (CN) ..... 2016 1 0081493

(51) Int. Cl.
*H05B 37/00* (2006.01)
*H05B 33/08* (2006.01)

(52) U.S. Cl.
CPC ..... *H05B 33/0845* (2013.01); *H05B 33/083* (2013.01); *H05B 33/0809* (2013.01); *H05B 33/0815* (2013.01); *H05B 33/0827* (2013.01); *H05B 33/0887* (2013.01)

(58) Field of Classification Search
CPC ..... H05B 33/0809; H05B 33/0815; H05B 33/0827; H05B 33/083; H05B 33/0887
USPC ..... 315/186, 201
See application file for complete search history.

(56) References Cited

U.S. PATENT DOCUMENTS

2009/0122580 A1* 5/2009 Stamm ..... H02M 7/15 363/44
2014/0204571 A1* 7/2014 Zhang ..... H05B 33/0809 362/222
2014/0306615 A1* 10/2014 Choi ..... H05B 33/0815 315/201
2014/0328065 A1* 11/2014 Barnetson ..... F21K 9/23 362/249.06
2015/0001937 A1* 1/2015 Wang ..... H01R 13/70 307/52
2015/0022108 A1* 1/2015 Malyna ..... H05B 33/0815 315/200 R
2015/0373792 A1* 12/2015 Kim ..... H05B 33/0824 315/201
2017/0290113 A1* 10/2017 Lissoni ..... H05B 33/0815

* cited by examiner

*Primary Examiner* — Tung X Le
(74) *Attorney, Agent, or Firm* — Rosenberg, Klein & Lee

(57) ABSTRACT

An LED driver of an LED tube includes: an AC-to-DC converting module converting an AC voltage received from a ballast into an intermediate DC voltage that is smaller than or equal to a predetermined threshold voltage, and a DC-to-DC converting module converting the intermediate DC voltage into a DC output voltage for driving LEDs of the LED tube.

9 Claims, 2 Drawing Sheets

LIGHT EMITTING DIODE DRIVER

CROSS-REFERENCE TO RELATED APPLICATION

This application claims priority of Chinese Patent Application No. 201610081493.5, filed on Feb. 5, 2016.

FIELD

The disclosure relates to a driver, and more particularly to a light emitting diode driver.

BACKGROUND

A conventional lighting system includes a ballast, and a fluorescent tube that is removably coupled to the ballast. When receiving an alternating current input voltage, the ballast starts the fluorescent tube and limits a current flowing through the fluorescent tube. If one who wishes to use a light emitting diode (LED) tube that is relatively energy saving in the conventional lighting system merely replaces the fluorescent tube with the LED tube such that an LED driver of the LED tube is coupled to the ballast, the LED driver would be damaged due to the operation of the ballast. In order to prevent damaging the LED driver, the ballast must be removed or bypassed before the installation of the LED tube, such that the LED driver is not coupled to the ballast after the installation.

SUMMARY

Therefore, an object of the disclosure is to provide a light emitting diode (LED) driver that can be coupled to a ballast and that prevents itself from being damaged due to operation of the ballast when coupled to the ballast.

According to the disclosure, a light emitting diode (LED) driver of an LED tube is provided. The LED tube includes a plurality of LEDs and is operatively associated with a ballast. The LED driver includes an AC-to-DC converting module and a DC-to-DC converting module. The AC-to-DC converting module is coupled to the ballast for receiving an AC (alternating current) voltage, and converts the AC voltage into an intermediate DC (direct current) voltage. A voltage value of the intermediate DC voltage is smaller than or equal to a voltage value of a predetermined threshold voltage. The DC-to-DC converting module is coupled to the AC-to-DC converting module for receiving the intermediate DC voltage, and converts the intermediate DC voltage into a DC output voltage for driving the plurality of LEDs.

BRIEF DESCRIPTION OF THE DRAWINGS

Other features and advantages of the disclosure will become apparent in the following detailed description of the embodiment (s) with reference to the accompanying drawings, of which.

DETAILED DESCRIPTION

Figure 1:
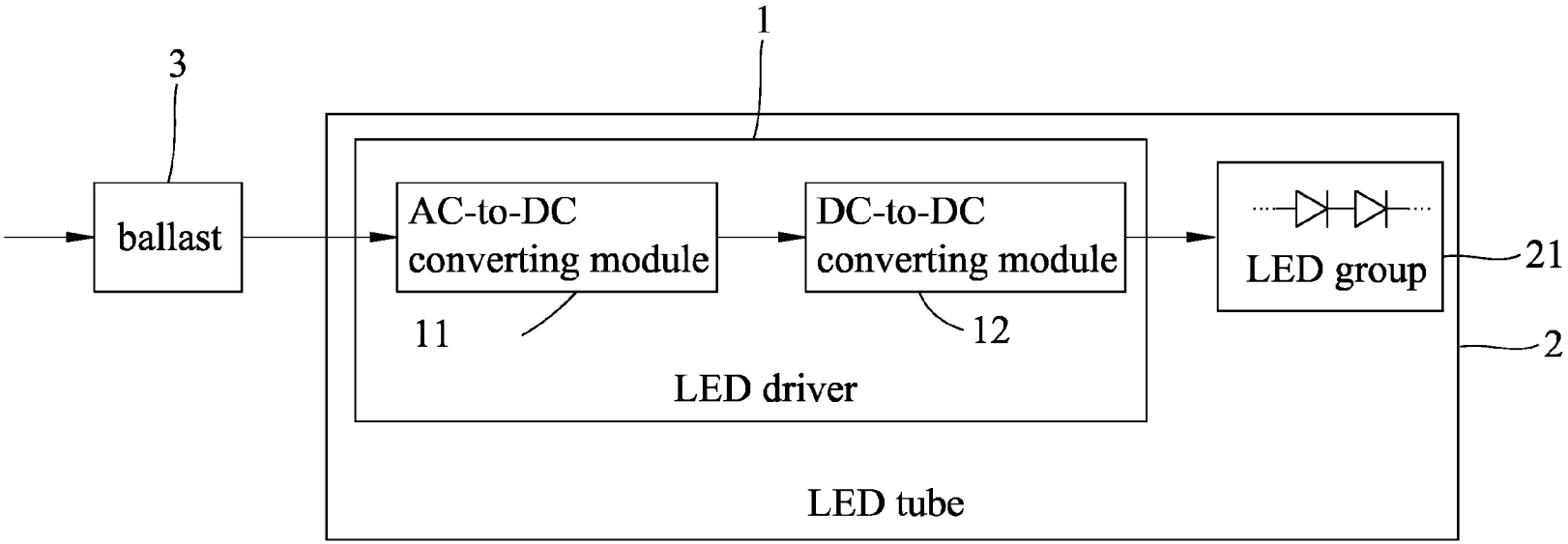
FIG. 1 is a block diagram illustrating an embodiment of a light emitting diode driver according to the disclosure.

Referring to FIG. 1, an embodiment of a light emitting diode (LED) driver 1 of an LED tube 2 according to the disclosure is provided. The LED tube 2 includes a plurality of LEDs 21 and is operatively associated with a ballast 3. When receiving an alternating current (AC) input voltage, the ballast 3 generates an AC ballast voltage, and limits a magnitude of a current provided thereby to be not greater than a predetermined current limit value. The LED driver 1 of this embodiment includes an AC-to-DC converting module 11 and a DC-to-DC converting module 12.

The AC-to-DC converting module 11 is coupled to the ballast 3 for receiving the ballast voltage therefrom, converts the AC output voltage into an intermediate DC (direct current) voltage, and a voltage value of the intermediate DC voltage is smaller than or equal to that of a predetermined threshold voltage.

The DC-to-DC converting module 12 is coupled to the AC-to-DC converting module 11 for receiving the intermediate DC voltage therefrom, is coupled further to the LEDs 21, and converts the intermediate DC voltage into a DC output voltage for driving the LEDs 21.

Figure 2:
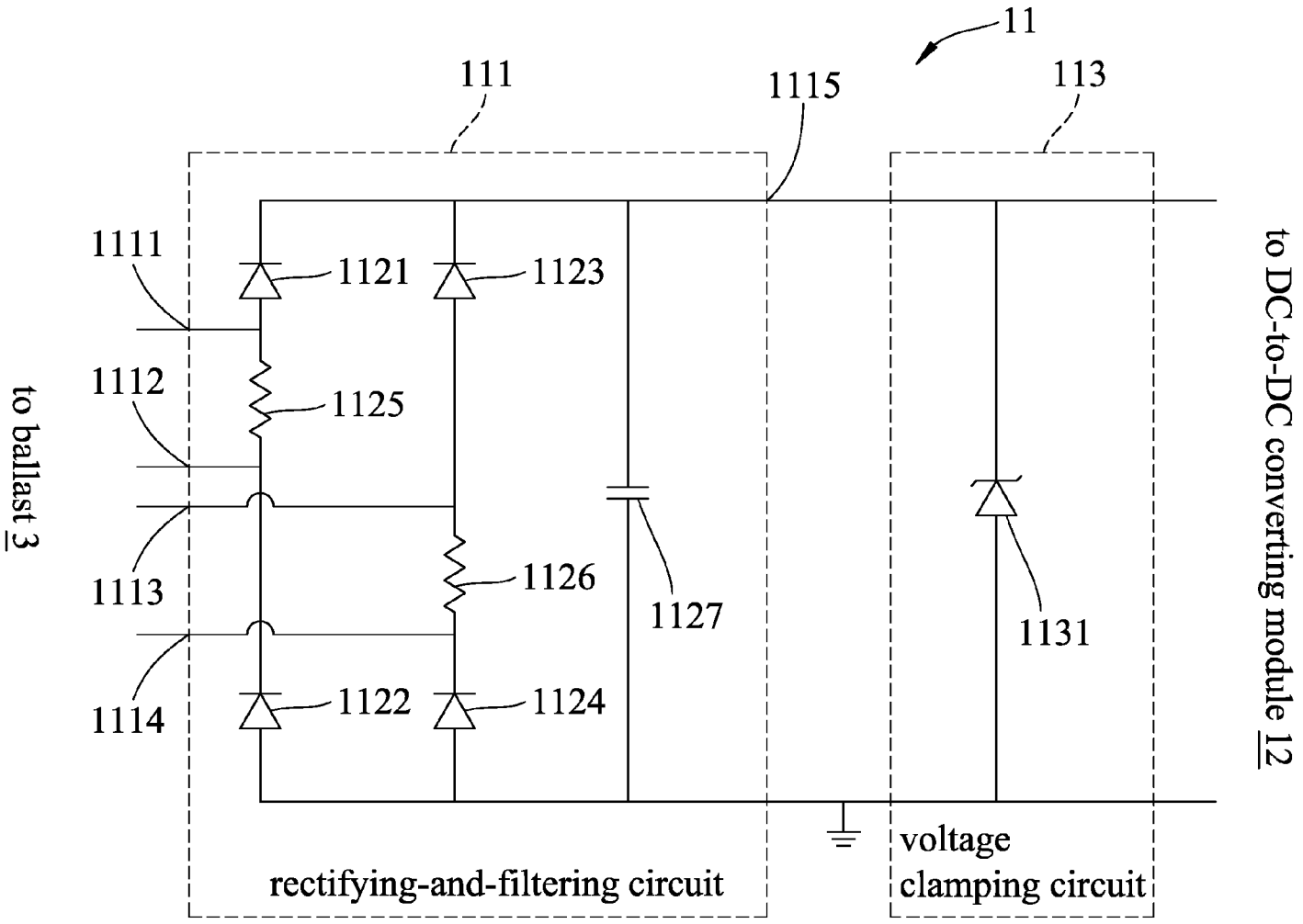
FIG. 2 is a circuit diagram illustrating an AC-to-DC converting module of the embodiment.

Referring to FIGS. 1 and 2, in this embodiment, the AC-to-DC converting module 11 includes a rectifying-and-filtering circuit 111 and a voltage clamping circuit 113.

The rectifying-and-filtering circuit 111 is coupled to the ballast 3 for receiving the ballast voltage therefrom, is coupled further to the DC-to-DC converting module 12, and generates, in response to the ballast voltage, the intermediate DC voltage for the DC-to-DC converting module 12 by rectifying and filtering the ballast voltage. In this embodiment, the rectifying-and-filtering circuit 111 includes a first input terminal 1111, a second input terminal 1112, a third input terminal 1113, a fourth input terminal 1114, an output terminal 1115, a first diode 1121, a second diode 1122, a third diode 1123, a fourth diode 1124, a first resistor 1125, a second resistor 1126 and a capacitor 1127. The first to fourth input terminals 1111-1114 are coupled to the ballast 3 for cooperatively receiving the ballast voltage therefrom. In practice, the first and second input terminals 1111, 1112 may respectively receive voltage signals having a same phase and different voltage magnitudes, the third and fourth input terminals 1113, 1114 may respectively receive voltage signals having a same phase and different voltage magnitudes, while the voltage signals received by the first and third input terminals 1111, 1113 have opposite phases. The output terminal 1115 is coupled to the DC-to-DC converting module 12, and is configured to output the intermediate DC voltage thereat. The first to fourth diodes 1121-1124 and the first and second resistors 1125, 1126 are cooperatively used for rectification. The first diode 1121 includes an anode coupled to the first input terminal 1111, and a cathode coupled to the output terminal 1115. The second diode 1122 includes an anode coupled to a reference node (e.g., ground), and a cathode coupled to the second input terminal 1112. The third diode 1123 includes an anode coupled to the third input terminal 1113, and a cathode coupled to the output terminal 1115. The fourth diode 1124 includes an anode coupled to the reference node, and a cathode coupled to the fourth input terminal 1114. The first resistor 1125 is coupled between the first and second input terminals 1111, 1112. The second resistor 1126 is coupled between the third and fourth input terminals 1113, 1114. The capacitor 1127 is used for filtering, and is coupled between the output terminal 1115 and the reference node.

The voltage clamping circuit 113 is coupled to the output terminal 1115 of the rectifying-and-filtering circuit 111 for receiving the intermediate DC voltage therefrom, and clamps the intermediate DC voltage to be smaller than or equal to the predetermined threshold voltage. In this embodiment, the voltage clamping circuit 113 includes a Zener diode 1131 with a breakdown voltage that serves as the predetermined threshold voltage. The Zener diode 1131 includes an anode coupled to the reference node, and a cathode coupled to the output terminal 1115 of the rectifying-and-filtering circuit 111.

As a result, a magnitude of the ballast voltage generated by the ballast 3 is limited by the AC-to-DC converting module 11 of this embodiment to be smaller than or equal to that of the predetermined threshold voltage, and thus a power outputted by the ballast 3 is not greater than a product of the voltage value of the predetermined threshold voltage and the predetermined current limit value.

When designing the LED driver 1 of this embodiment, one can determine the predetermined threshold voltage according to the following equation:

$$Vlimit = \frac{P113 + (Vout \times I21)/\eta 12}{Ilimit},$$

where Vlimit denotes the predetermined threshold voltage, P113 denotes a predetermined maximum power consumption of the voltage clamping circuit 113, Vout denotes the output voltage, I21 denotes a current flowing through the LEDs 21, η12 denotes conversion efficiency of the DC-to-DC converting module 12, and Ilimit denotes the predetermined current limit value.

In view of the above, in this embodiment, with the AC-to-DC converting module 11 making the intermediate DC voltage smaller than or equal to the predetermined threshold voltage, the LED driver 1 has the following advantages:

1. The LED driver 1 can be coupled to the ballast 3, and prevents itself from being damaged due to the operation of the ballast 3 when coupled to the ballast 3.

2. The LED driver 1 can limit the power outputted by the ballast 3 and thus a power inputted to the ballast 3, thereby saving energy.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is (are) considered the exemplary embodiment(s), it is understood that the disclosure is not limited to the disclosed embodiment(s) but is intended to cover various arrangements included within the spirit and scope of the broadest interpretation so as to encompass all such modifications and equivalent arrangements.

What is claimed is:

1. A light emitting diode (LED) driver of an LED tube, the LED tube including a plurality of LEDs and being operatively associated with a ballast, the LED driver comprising:

an AC-to-DC converting module configured to receive an AC (alternating current) voltage output of the ballast, and converting the AC voltage into an intermediate DC (direct current) voltage, and wherein a voltage value of the intermediate DC voltage is smaller than or equal to a voltage value of a predetermined threshold voltage; and a DC-to-DC converting module coupled to the AC-to-DC converting module for receiving the intermediate DC voltage, and converting the intermediate DC voltage to a DC output voltage for driving the plurality of LEDs;

wherein the AC-to-DC converting module includes a rectifying-and-filtering circuit including:

a first input terminal, a second input terminal, a third input terminal and a fourth input terminal coupled to the ballast for receiving the AC voltage, an output terminal coupled to the DC-to-DC converting module and configured to output the intermediate DC voltage, a first diode including an anode coupled to the first input terminal, and a cathode coupled to the output terminal, a second diode including an anode coupled to a reference node, and a cathode coupled to the second input terminal, a third diode including an anode coupled to the third input terminal, and a cathode coupled to the output terminal, a fourth diode including an anode coupled to the reference node, and a cathode coupled to the fourth input terminal, a first resistor coupled between the first and second input terminals, and a second resistor coupled between the third and fourth input terminals.

2. The LED driver of claim 1, wherein the rectifying-and-filtering circuit further includes a capacitor coupled between the output terminal and the reference node.

3. A lighting system comprising:

a ballast generating an AC (alternating current) voltage; and a light emitting diode (LED) tube including a plurality of LEDs and an LED driver;

wherein the LED driver includes an AC-to-DC converting module coupled to the ballast for receiving the AC voltage from the ballast, and converting the AC voltage into an intermediate DC (direct current) voltage, and wherein a voltage value of the intermediate DC voltage is smaller than or equal to a voltage value of a predetermined threshold voltage, and a DC-to-DC converting module coupled to the AC-to-DC converting module for receiving the intermediate DC voltage, and converting the intermediate DC voltage to a DC output voltage for driving the plurality of LEDs;

wherein the AC-to-DC converting module includes a rectifying-and-filtering circuit including:

a first input terminal, a second input terminal, a third input terminal and a fourth input terminal coupled to the ballast for receiving the AC voltage, an output terminal coupled to the DC-to-DC converting module and configured to output the intermediate DC voltage, a first diode including an anode coupled to the first input terminal, and a cathode coupled to the output terminal, a second diode including an anode coupled to a reference node, and a cathode coupled to the second input terminal, a third diode including an anode coupled to the third input terminal, and a cathode coupled to the output terminal, a fourth diode including an anode coupled to the reference node, and a cathode coupled to the fourth input terminal, a first resistor coupled between the first and second input terminals, and a second resistor coupled between the third and fourth input terminals.

4. The lighting system of claim 3, wherein the AC-to-DC converting module further includes:

a voltage clamping circuit coupled to the output terminal of the rectifying-and-filtering circuit for receiving the intermediate DC voltage, and configured to clamp the intermediate DC voltage.

5. The lighting system of claim 4, wherein the voltage clamping circuit includes a Zener diode, wherein the Zener diode includes an anode coupled to the reference node, and a cathode coupled to the output terminal of the rectifying-and-filtering circuit.

6. The lighting system of claim 3, wherein the rectifying-and-filtering circuit further includes a capacitor coupled between the output terminal and the reference node.

7. A light emitting diode (LED) driver of an LED tube, the LED tube including a plurality of LEDs and being operatively associated with a ballast, the LED driver comprising:

an AC-to-DC converting module coupled to the ballast for receiving an AC (alternating current) voltage, and converting the AC voltage into an intermediate DC (direct current) voltage, and wherein a voltage value of the intermediate DC voltage is smaller than or equal to a voltage value of a predetermined threshold voltage; and a DC-to-DC converting module coupled to the AC-to-DC converting module for receiving the intermediate DC voltage, and converting the intermediate DC voltage to a DC output voltage for driving the plurality of LEDs;

wherein the AC-to-DC converting module includes:

a rectifying-and-filtering circuit coupled to the ballast for receiving the AC voltage, wherein the rectifying-and-filtering circuit is configured to generate, in response to the AC voltage, the intermediate DC voltage which is provided to the DC-to-DC converting module; and a voltage clamping circuit coupled to the rectifying-and-filtering circuit for receiving the intermediate DC voltage, and configured to clamp the intermediate DC voltage;

wherein the rectifying-and-filtering circuit includes:

a first input terminal, a second input terminal, a third input terminal and a fourth input terminal coupled to the ballast for receiving the AC voltage;

an output terminal coupled to the voltage clamping circuit and the DC-to-DC converting module and configured to output the intermediate DC voltage;

a first diode including an anode coupled to the first input terminal, and a cathode coupled to the output terminal;

a second diode including an anode coupled to a reference node, and a cathode coupled to the second input terminal;

a third diode including an anode coupled to the third input terminal, and a cathode coupled to the output terminal;

a fourth diode including an anode coupled to the reference node, and a cathode coupled to the fourth input terminal;

a first resistor coupled between the first and second input terminals; and a second resistor coupled between the third and fourth input terminals.

8. The LED driver of claim 7, wherein the rectifying-and-filtering circuit further includes a capacitor coupled between the output terminal and the reference node.

9. The LED driver of claim 7, wherein the voltage clamping circuit includes a Zener diode, wherein the Zener diode includes an anode coupled to the reference node, and a cathode coupled to the output terminal of the rectifying-and-filtering circuit.

* * * * *